US007429234B2

(12) United States Patent
Yang et al.

(10) Patent No.: US 7,429,234 B2
(45) Date of Patent: Sep. 30, 2008

(54) OVAL TRACK STEPPER

(75) Inventors: Chang-Hsin Yang, Shalu Township, Taichung County (TW); Ya-Chi Chen, 4F., No. 51, Lane 62, Jhengyi S. Rd., Sanchong City, Taipei County (TW)

(73) Assignee: Ya-Chi Chen, Sanchong, Taipei County (TW)

( * ) Notice: Subject to any disclaimer, the term of this patent is extended or adjusted under 35 U.S.C. 154(b) by 63 days.

(21) Appl. No.: 11/537,834

(22) Filed: Oct. 2, 2006

(65) Prior Publication Data

US 2007/0087904 A1 Apr. 19, 2007

(30) Foreign Application Priority Data

Oct. 19, 2005 (TW) ..... 94218064 U

(51) Int. Cl.
*A63B 22/00* (2006.01)
*A63B 22/04* (2006.01)

(52) U.S. Cl. ..... 482/52; 482/51

(58) Field of Classification Search ..... 482/51–53, 482/57, 70, 79–80, 63
See application file for complete search history.

(56) References Cited

U.S. PATENT DOCUMENTS 6,689,020 B2 * 2/2004 Stearns et al. ..... 482/52
6,835,166 B1 * 12/2004 Stearns et al. ..... 482/52
7,041,036 B1 * 5/2006 Kuo ..... 482/52

* cited by examiner

*Primary Examiner*—Steve R Crow
(74) *Attorney, Agent, or Firm*—Egbert Law Offices.

(57) ABSTRACT

The present invention is an oval track stepper, which has resolved the disadvantage of a typical oval track stepper by having rear ends of left and right stepping rods linked to left and right sides of a freewheel set and the enclosure, leading to excessive spacing against stepping comfort. The oval track stepper includes a main frame, a head frame, left and right stepping rods, left and right vertical swing rods, a freewheel set and damping device. The freewheel set and damping device are mounted externally at left and right stepping rods. An obstruction-free and closer space between left and right stepping rods delivers an optimum stepping distance for the users, thus improving comfort and practicability.

3 Claims, 9 Drawing Sheets

OVAL TRACK STEPPER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an oval track stepper, and more particularly to an improved structure of an oval track stepper in which a freewheel set and damping device are mounted at left and right stepping rods separately.

2. Description of Related Art Including Information Disclosed Under 37 CFR 1.97 and 37 CFR 1.98.

A typical oval track stepper is shown in FIG. 1, where the rear ends of left and right stepping rods 11, 12 are linked to left and right sides of freewheel set 13. The rotating freewheel set 13 drives the ends of left and right stepping rods 11, 12 accordingly. A freewheel set 13 is often accommodated by an enclosure 14 to achieve an aesthetic effect. However, if the designed width of the enclosure is to be met, there will be excessive spacing between the left and right stepping rods, making an unacceptable stepping distance between a user's feet, that is, exceeding the width of the shoulders of the user. In such a case, it is likely to lead to discomfort of the feet or even personal injury.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

Based upon the innovative structure of the present invention, the freewheel set 50 and damping device 60 are mounted externally at stepping rods 31, 32. An obstruction-free and closer space between left and right stepping rods 31, 32 delivers an optimum stepping distance for the users, thus improving comfort and practicability.

The rear ends of left and right stepping rods 31, 32 are linked via a coupler, such that the left and right stepping rods can move synchronously to ensure the stability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
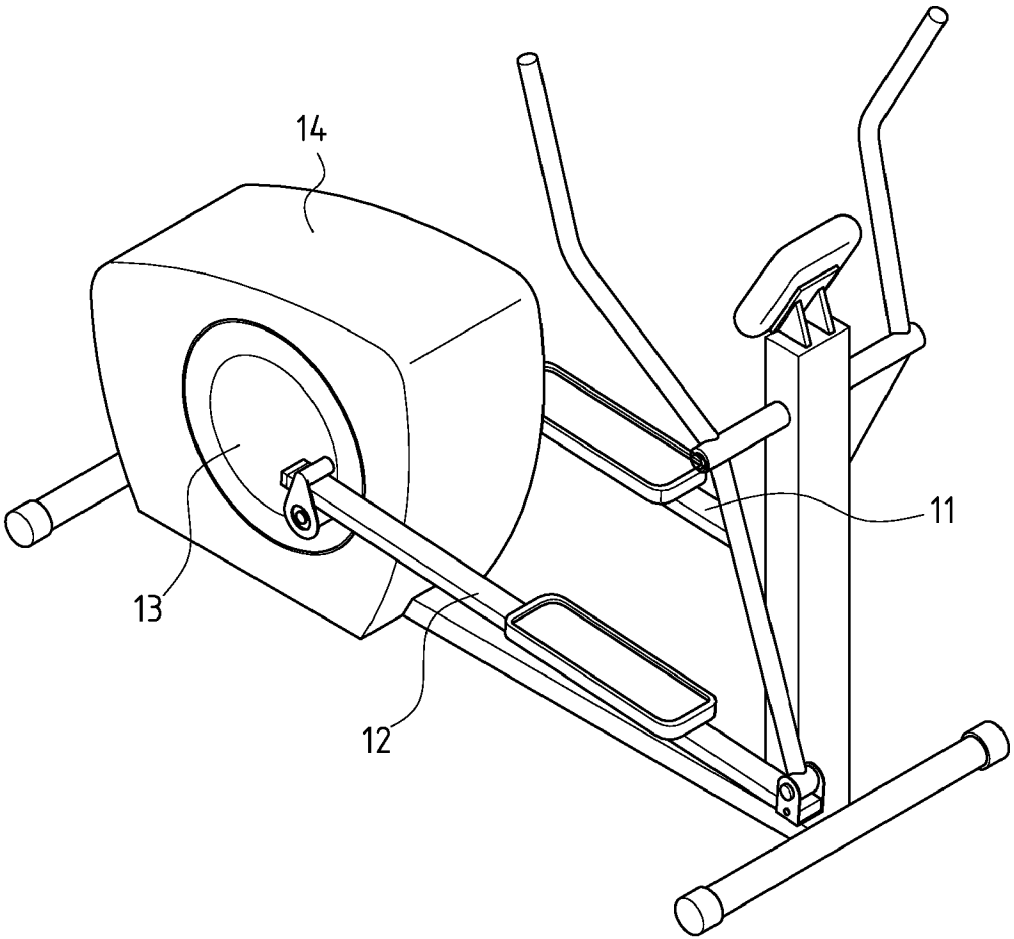
FIG.1 PRIOR ART
FIG. 1 shows a perspective view of the prior art.

The features and the advantages of the present invention will be more readily understood upon a thoughtful deliberation of the following detailed description of a preferred embodiment of the present invention with reference to the accompanying drawings.

FIGS. 2, 3, 4, 5 depict preferred embodiments of the oval track stepper of the present invention, which are provided for only explanatory purpose for patent claims. The oval track stepper comprises a main frame 20, a head frame 21, left and right stepping rods 31, 32, left and right vertical swing rods 41, 42, a freewheel set 50, and a damping device 60. The left and right stepping rods 31, 32 are alternatively arranged. The front ends of the stepping rods are coupled to respective bottoms of the left and right vertical swing rods 41, 42, and the rear ends of stepping rods 31, 32 are linked to an eccentric position of the freewheel set 50.

The freewheel set 50 and damping device 60 are laterally mounted at stepping rods 31, 32, such that the ends of left and right stepping rods 31, 32 are linked through a coupler (illustrated in the figures).

Figure 2:
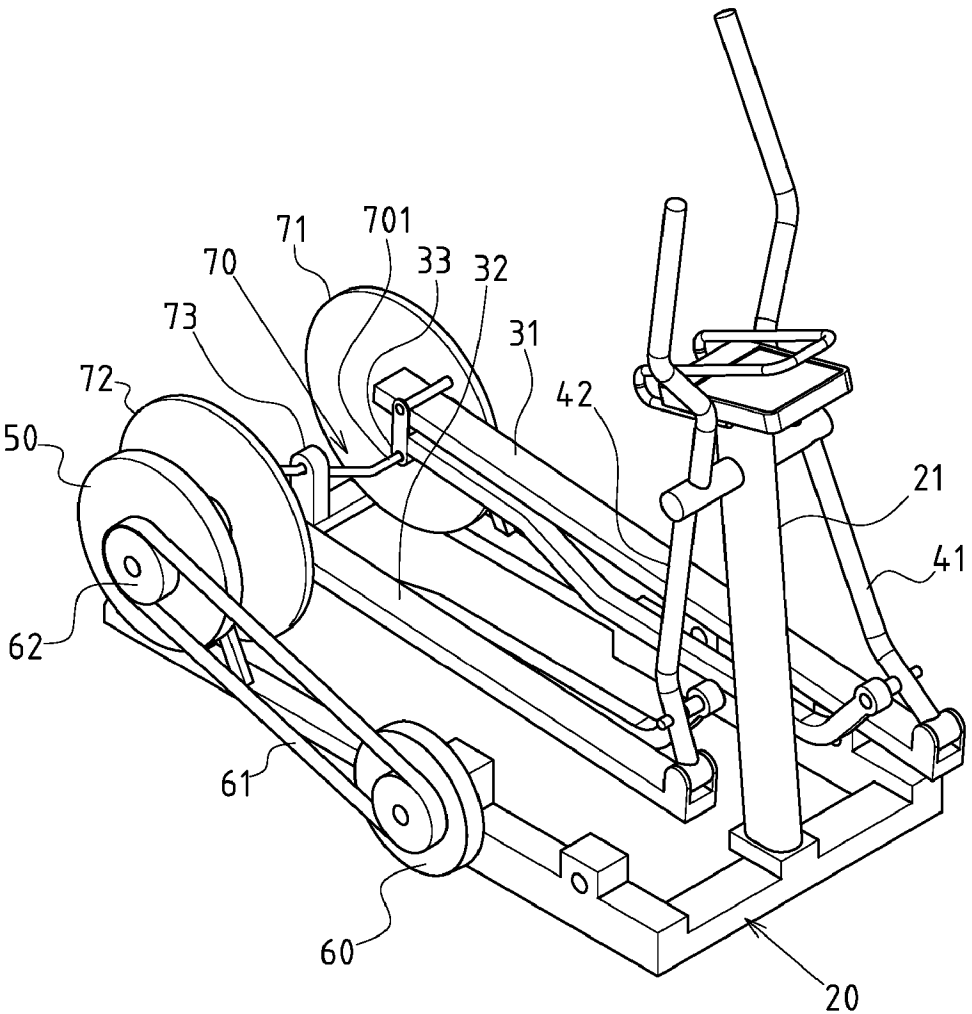
FIG. 2 shows a perspective view of the preferred embodiment of the present invention.

Referring to FIG. 2, the damping device 60 may be a magnetic wheel, which is linked through a drive belt 61 to a belt pulley 62 outside of freewheel set 50.

Figure 3:
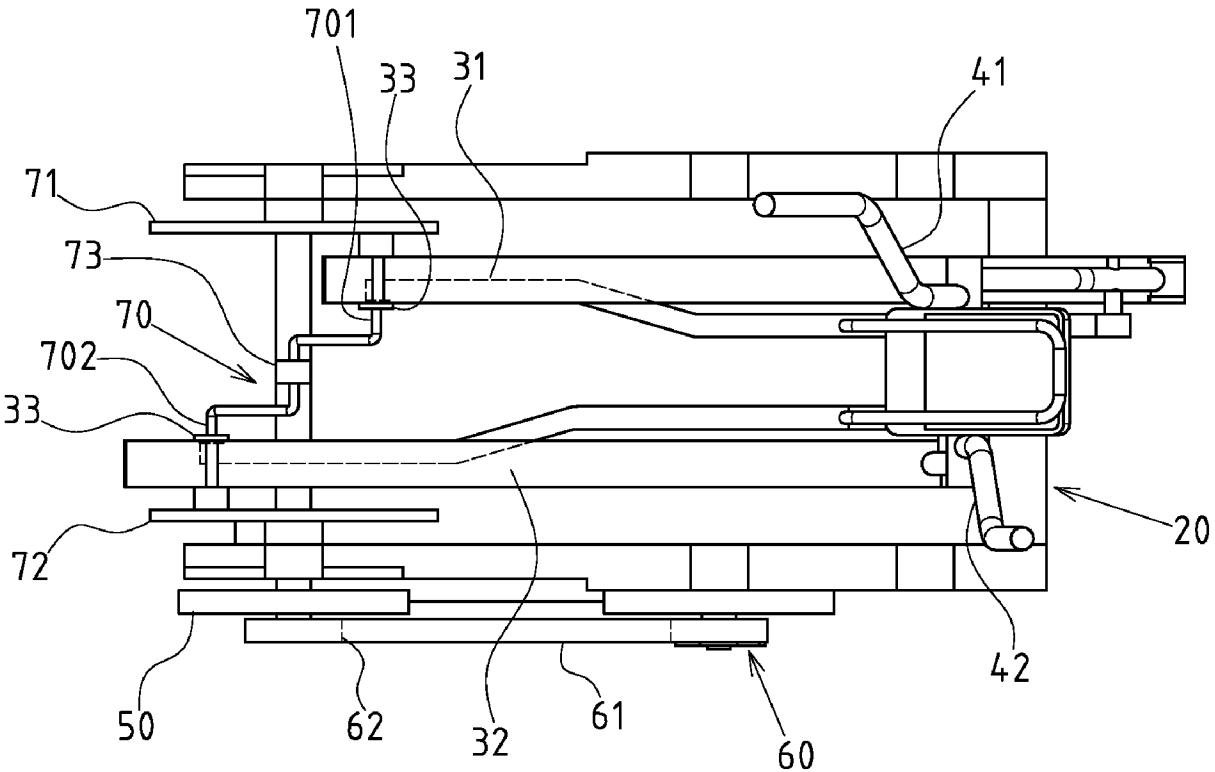
FIG. 3 shows a top plan view of the preferred embodiment of the present invention.

Referring also to FIGS. 2, 3, the preferred embodiment of the coupler may be a crank 70. Left and right side auxiliary wheels 71, 72 are additionally mounted externally at rear ends of left and right stepping rods 31, 32, such that the left and right ends 701, 702 of the crank 70 are separately adapted to the coupling seat 33 at rear ends of left and right stepping rods 31, 32. The middle section of crank 70 is sustained by a support 73.

Figure 6:
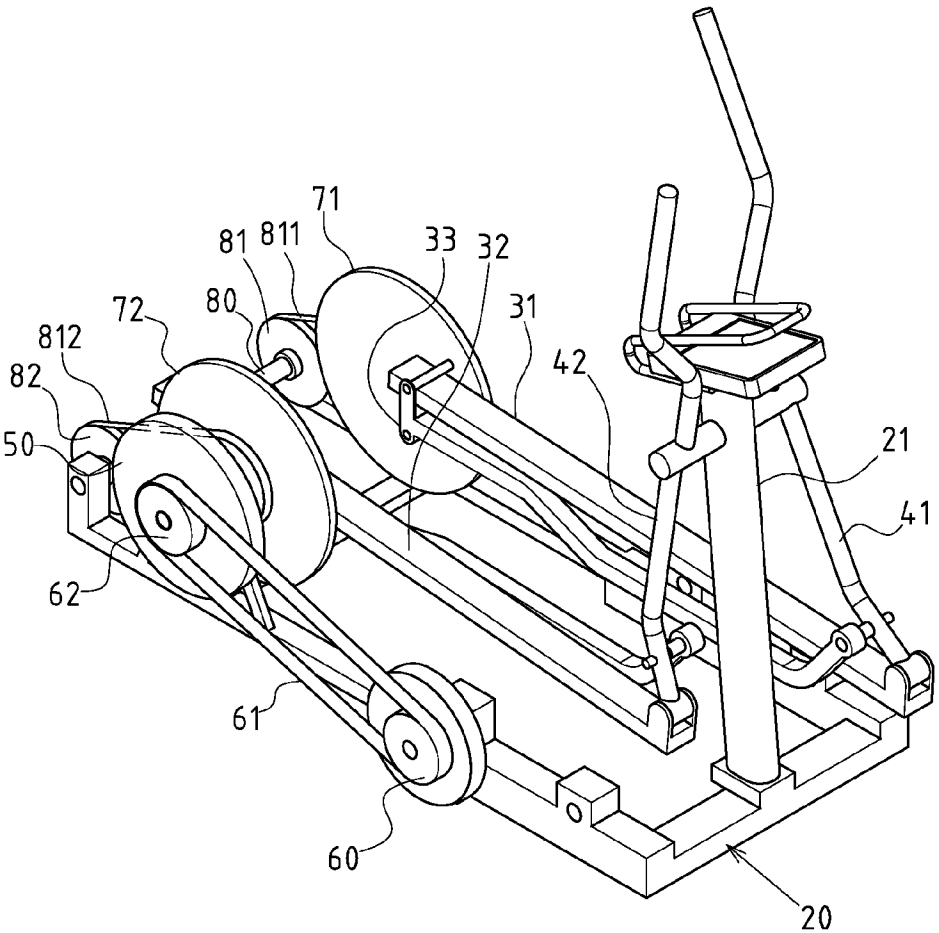
FIG. 6 shows a perspective view of another preferred embodiment of the present invention.
Figure 7:
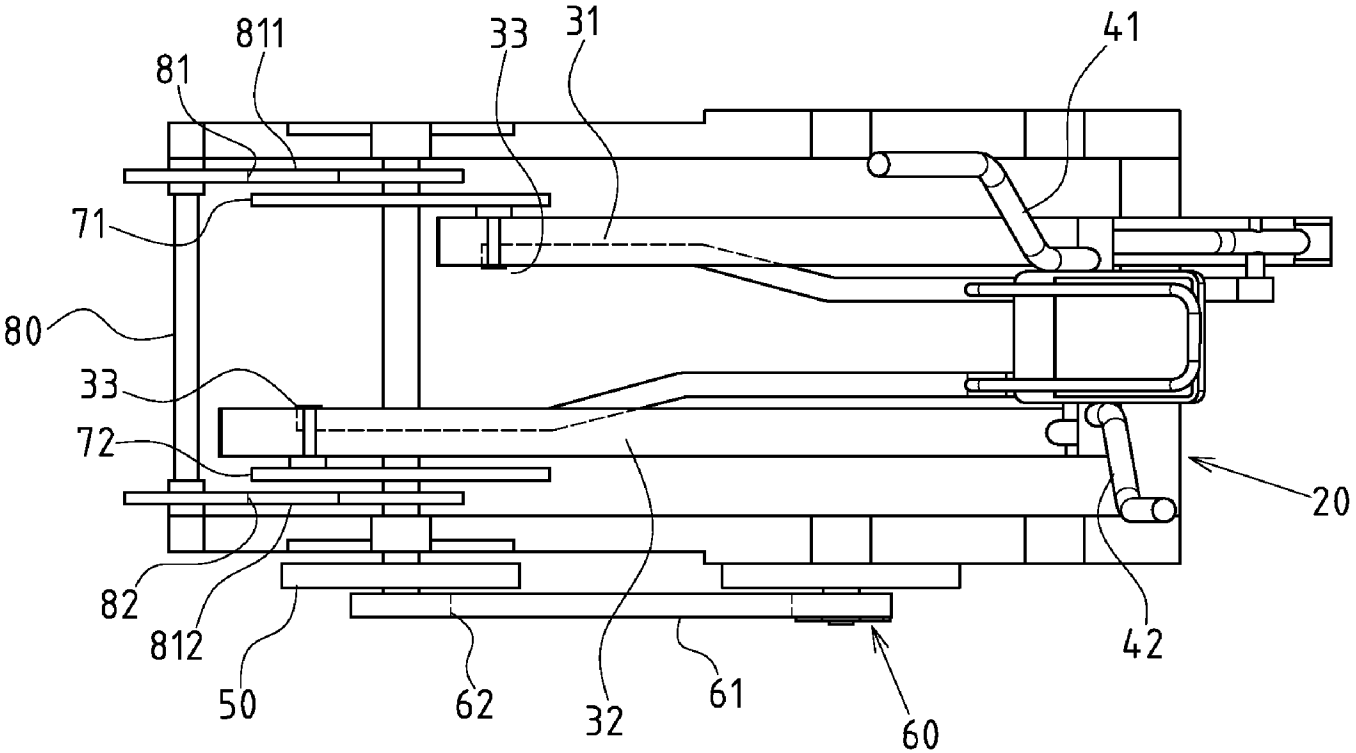
FIG. 7 shows a top plan view of embodiment of FIG. 6.

Referring also to FIGS. 6, 7, the coupler may also be a belt pulley set, which comprises a shaft lever 80, first and second pulley 81, 82 at left and right sides of the shaft lever, a first drive belt 811 used to link the rear end of left stepping rod 31 to first belt pulley 81, and a second drive belt 812 used to link the rear end of right stepping rod 32 to second belt pulley 82.

Figure 8:
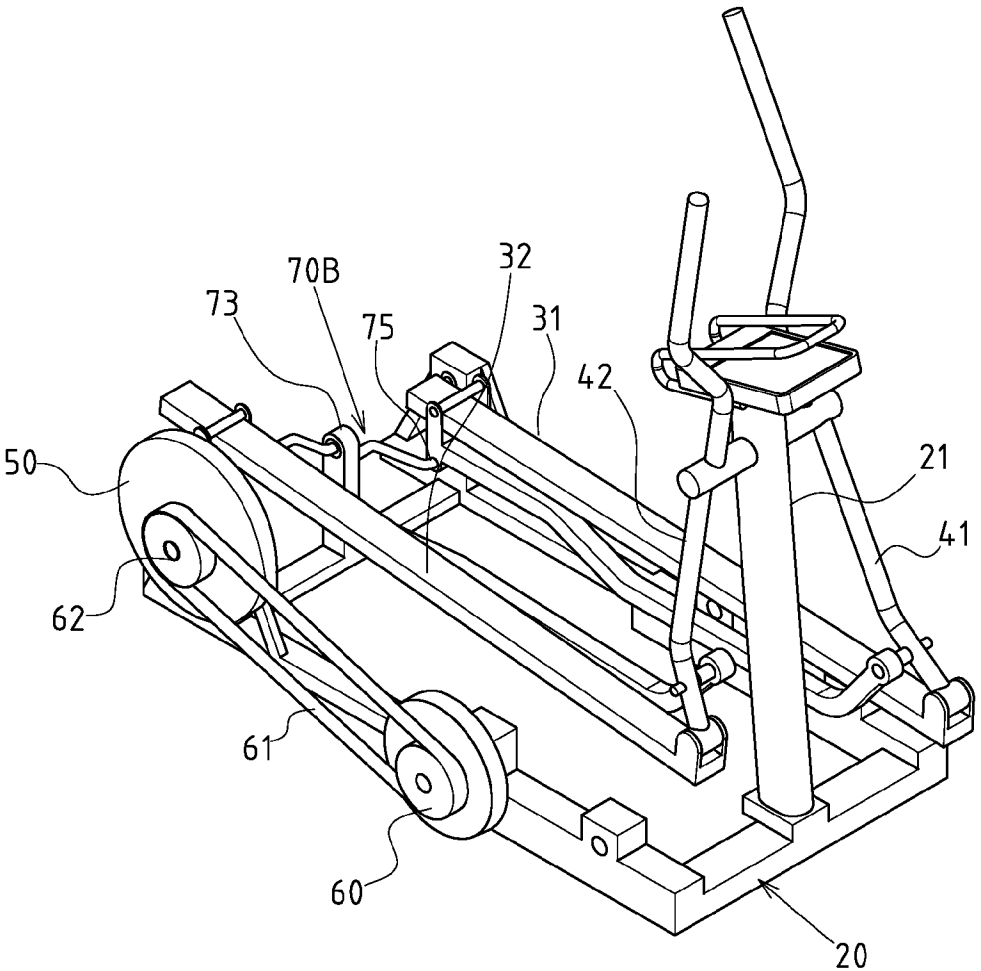
FIG. 8 shows a perspective view of still another preferred embodiment of the present invention.
Figure 9:
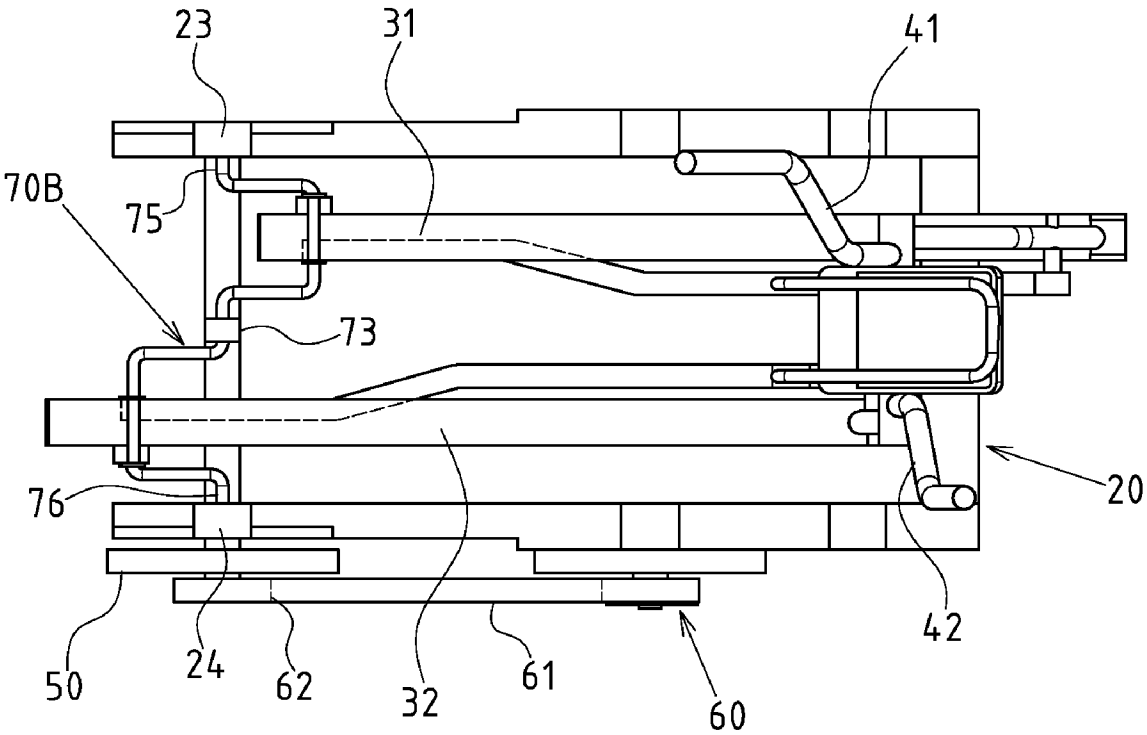
FIG. 9 shows a top plan view of the embodiment of FIG. 8.

Referring also to FIG. 8, the preferred embodiment of coupler may be only a single crank 70B without aforementioned left and right side auxiliary wheels 71, 72. So, the left and right sides 75, 76 of the crank 70B are coupled to a pivotal frame 23, 24 at left and right sides of a rear section of the main frame 20 for a stable support during rotation.

Based upon above-specified structural design, operating instruction of the present invention is described as follows.

Figure 4:
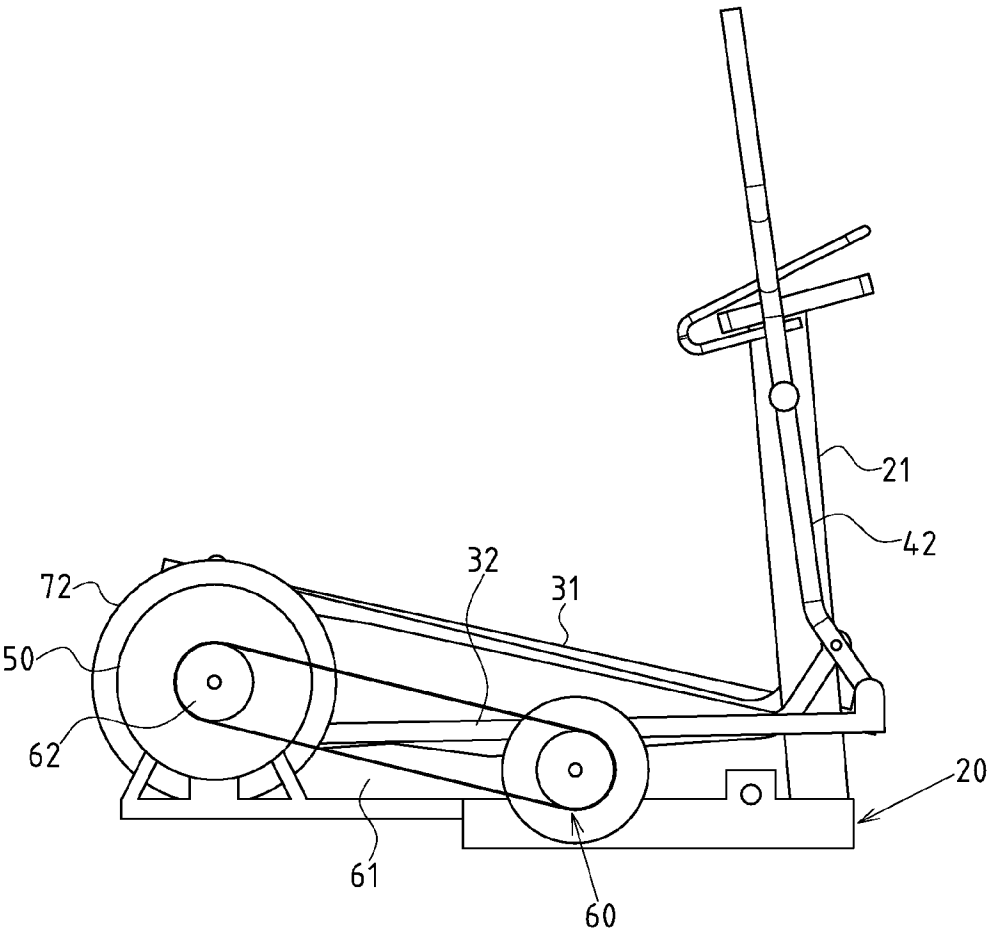
FIG. 4 shows a side elevation view of the preferred embodiment of the present invention.
Figure 5:
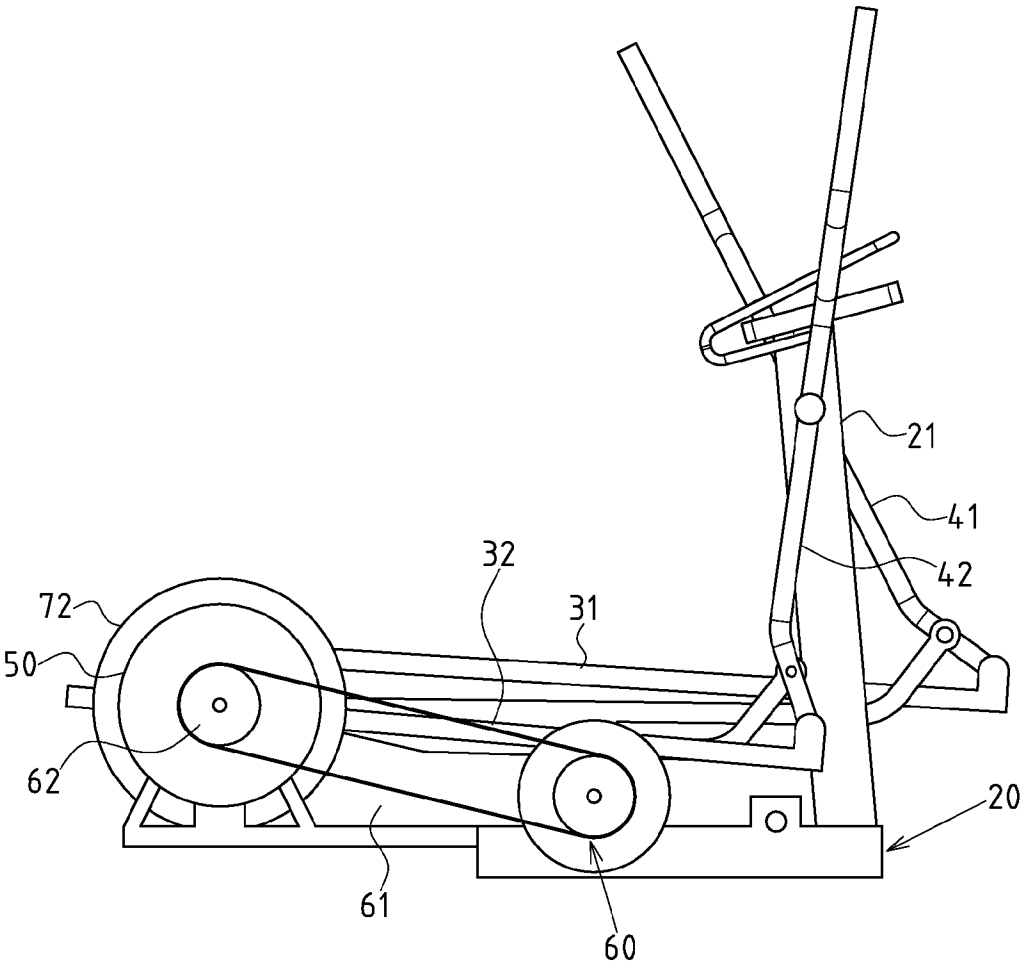
FIG. 5 shows a side elevation view of the preferred embodiment of the present invention in operation.

An oval track stepper of the present invention is shown in FIGS. 4, 5, where the front end of left and right stepping rods 31, 32 swing transversely with the bottoms of left and right vertical swing rods 41, 42, while the rear ends of left and right stepping rods 31, 32 swing vertically with the rotation of left and right side auxiliary wheels 71, 72, along with the drive of crank 70 (illustrated in FIGS. 2, 3). Thus, left and right stepping rods 31, 32 could move circularly similar to an oval track.

A feature of the oval track stepper of the present invention lies in an improved space, rather than its drive part. Referring to FIG. 3, the freewheel set 50 and damping device 60 of the present invention are mounted externally at stepping rods, such that an obstruction-free and closer space is shaped between left and right stepping rods 31, 32, enabling them to meet optimal stepping requirements.

We claim:

1. An oval track stepper comprising:

a main frame;

a head frame attached to said main frame;

left and right stepping rods being alternately arranged;

left and right vertical swing rods each having a bottom portion respectively coupled to a front end of said left and right stepping rods;

a freewheel set being linked to the rear ends of said left and right stepping rods at an eccentric position; and a damping device being mounted extending at said left and right stepping rods with said freewheel set, said rear ends of said left and right stepping rods being linked via a coupler, said coupler being a belt pulley set, said belt pulley set comprising:

a shaft lever;

a first pulley and a second pulley at opposite sides of said shaft lever;

a first drive belt linking the rear end of said left stepping rod to said first pulley; and a second drive belt linking the rear end of said right stepping rod to said second pulley.

2. The oval track stepper of claim 1, said damping device comprising a magnetic wheel linked to said freewheel set.

3. The oval tack stepper of claim 1, further comprising:

left and right side auxiliary wheels mounted externally at respective rear ends of said left and right stepping rods.

* * * * *